US011312585B1

(12) United States Patent
Sanders et al.

(10) Patent No.: US 11,312,585 B1
(45) Date of Patent: Apr. 26, 2022

(54) SYSTEM AND METHOD FOR MANAGING REMOVABLE MECHANICAL MODIFICATIONS TO A PRINTING DEVICE

(71) Applicant: Xerox Corporation, Norwalk, CT (US)

(72) Inventors: Kenneth D. Sanders, Rochester, NY (US); Arthur H. Kahn, Wayland, NY (US); Dara Nanette Lubin, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 17/194,555

(22) Filed: Mar. 8, 2021

(51) Int. Cl.
*B65H 1/26* (2006.01)

(52) U.S. Cl.
CPC ..... *B65H 1/26* (2013.01)

(58) Field of Classification Search
CPC ..... B23Q 1/037; B23Q 1/032; B65H 1/14; B65H 1/26; B65H 2220/01; B65H 2701/1113; B65H 7/00; B65H 2402/30; B65H 2402/32; B65H 2402/34; B65H 2405/11161; B65H 2701/1125; B65H 2701/11252
See application file for complete search history.

(56) References Cited

U.S. PATENT DOCUMENTS 6,386,805 B1 * 5/2002 Suzuki ..... B23Q 1/035 269/21
6,488,060 B1 * 12/2002 Giovanni ..... B25B 11/005 144/135.2
6,607,336 B1 * 8/2003 Suzuki ..... B23Q 1/032 409/163
6,764,434 B1 * 7/2004 Volk ..... B23Q 1/032 144/48.1
7,458,574 B2 12/2008 Wilcox et al.
8,348,259 B2 * 1/2013 Marasco ..... B65H 7/00 271/148

* cited by examiner

*Primary Examiner* — Gregory W Adams
(74) *Attorney, Agent, or Firm* — Simpson & Simpson, PLLC; Michael Nicholas Vranjes

(57) ABSTRACT

A method of managing removable mechanical modifications to one or more printing devices, including receiving, by one or more computer processors, an input related to a removable mechanical modification of a printing device of the one or more printing devices, and determining, by the one or more computer processors, a location of the removable mechanical modification.

19 Claims, 11 Drawing Sheets

SYSTEM AND METHOD FOR MANAGING REMOVABLE MECHANICAL MODIFICATIONS TO A PRINTING DEVICE

FIELD

The present disclosure relates to the field of printing, and more particularly, to a system and method for managing mechanical modifications to printing devices, and even more particularly, to a system and method for managing an adjustable leveling assembly used to modify a printing device for specialty media that results in irregular thickness when stacked.

BACKGROUND

Current printers and printing systems allow for the feeding of specialty stocks with cards, labels, and stickers. For example, custom or specialty media or sheets exist that allow for users to print out cards (e.g., business cards, greeting cards, post cards, etc.), labels, stickers etc. These custom sheets might comprise a full sheet geometry with the card, label, and/or sticker arranged at a first end of the end of the sheet.

When too many of these custom sheets are arranged on the feeder tray forming a stack, the top surface of the stack is higher in one corner or at one end of the stack causing the feeder tray height sensor therein to read incorrectly and cause misfeeds. As such, current printers and printing systems are limited to only stacking small quantities of custom sheets in the feeder tray due to the unlevel geometry of the stack of sheets.

Furthermore, current devices to remedy the unlevel geometry of the stack of custom or specialty sheets only allow for short edge feeding, which users do not prefer due to slower productivity, and provide a flat linear ramp, spring loaded across one side, only allowing for cards with uniform geometry across the end. Such current devices do not allow for media that has one card in a corner or one card or label in the middle.

Therefore, there is a long felt need for an adjustable leveling assembly for specialty media that can be arranged in current print feeder trays to enable level stacks of specialty media. There is also a long felt need for a system and method of monitoring printing devices that have been modified, and specifically, printing devices that have been modified with an adjustable leveling assembly.

SUMMARY

According to aspects illustrated herein, there is provided a method of managing removable mechanical modifications to one or more printing devices, comprising receiving, by one or more computer processors, an input related to a removable mechanical modification of a printing device of the one or more printing devices, and determining, by the one or more computer processors, a location of the removable mechanical modification.

In some embodiments, the input is received from the printing device. In some embodiments, the removable mechanical modification is detected by a sensor of the printing device, and the input is received from a transmitter of the printing device. In some embodiments, the removable mechanical modification comprises modifying a feeder tray of the printing device to include an adjustable leveling assembly. In some embodiments, the input is received from a transmission device of the adjustable leveling assembly. In some embodiments, the method further comprises determining, by the one or more computer processors, that the input is related to a request for the location, and sending, by the one or more computer processors, the location. In some embodiments, the step of sending the location comprises sending, by the one or more computer processors, a name of the printing device. In some embodiments, the step of sending the location comprises displaying, by the one or more computer processors, the location on a user interface. In some embodiments, the method further comprises determining, by the one or more computer processors, that the input is not related to a request for the location, and storing, by the one or more computer processors, the location. In some embodiments, the method further comprises sending, by the one or more computer processors, an alert indicating that a removable mechanical modification to the feeder tray exists. In some embodiments, the method further comprises sending, by one or more computer processors, a notification to monitor an output stacker of the printing device.

According to aspects illustrated herein, there is provided a computer system for managing removable mechanical modifications to a printing system, comprising at least one printing device, including a feeder tray, an output stacker, and a first user interface, an adjustable leveling assembly including a transmission device, one or more computer processors, one or more computer readable storage media, program instructions stored on the computer readable storage media for execution by at least one of the one or more computer processors, the program instructions comprising program instructions to receive an input related to a removable mechanical modification, and program instructions to determine a location of the removable mechanical modification.

In some embodiments, the removable mechanical modification comprises the arrangement of the adjustable leveling assembly on the feeder tray. In some embodiments, the input is received from the first user interface. In some embodiments, the input is received from the transmission device of the adjustable leveling assembly. In some embodiments, the computer system further comprises program instructions to determine that the input is related to a request for the location, and program instructions to send the location. In some embodiments, the program instructions to send the location comprise program instructions to display the location on a second user interface. In some embodiments, the computer further comprises program instructions to determine that the input is not related to a request for the location, and program instructions to store the location. In some embodiments, the computer system further comprises program instructions to send an alert indicating that the adjustable leveling assembly is arranged on the feeder tray. In some embodiments, the computer further comprises program instructions to send an alert indicating that the adjustable leveling assembly is arranged on the feeder tray, and program instructions to send a notification to monitor the output stacker.

According to aspects illustrated herein, there is provided method of managing removable mechanical modifications to a plurality of printing devices, comprising receiving an indication that a feeder tray of a printing device of the plurality of printing devices has been modified to include an adjustable leveling assembly, determining a location of the printing device, storing the location, and sending an alert indicating that the adjustable leveling assembly is arranged on the feeder tray.

In some embodiments, the method further comprises receiving a request for the location, and displaying the location on a user interface.

According to aspects illustrated herein, there is provided an adjustable leveling assembly for a feeder tray of a printer, comprising a body, including a top surface, and a bottom surface operatively arranged to engage the feeder tray, and a first wedging element slidably connected to the body and operatively arranged to engage a stack of sheets.

In some embodiments, the body further comprises a first side wall extending from the top surface to the bottom surface, and a second side wall extending from the top surface to the bottom surface, the second side wall spaced apart from the first side wall. In some embodiments, the first wedging element comprises a first cross-member engaged with the first side wall and the second side wall, a second cross-member engaged with the first side wall and the second side wall, and at least one surface that extends between the first cross-member and the second cross-member. In some embodiments, the at least one surface comprises a first surface extending from the first cross-member, a second surface extending from the second cross-member, and a third surface connecting the first surface and the second surface. In some embodiments, the first surface and the second surface are planar, and the third surface is curvilinear. In some embodiments, the adjustable leveling assembly further comprises a cutout arranged in at least one of the first surface and the second surface. In some embodiments, the first cross-member and the second cross-member are arranged below the top surface, and the at least one surface is arranged above the top surface. In some embodiments, the top surface comprises an aperture and the at least one surface extends through the aperture. In some embodiments, the adjustable leveling assembly further comprises a first pair of tracks, wherein the first wedging element is engaged with the first pair of tracks via at least one roller. In some embodiments, the adjustable leveling assembly further comprises a second pair of tracks spaced apart from the first pair of tracks and a second wedging element, wherein the second wedging element is engaged with the second pair of tracks. In some embodiments, each track of the first pair of tracks comprises a channel and at least one space. In some embodiments, the adjustable leveling assembly further comprises at least one plate operatively arranged to be removably engaged with the at least one space. In some embodiments, the adjustable leveling assembly further comprises a locking mechanism operatively arranged to fixedly secure the first wedging element to the body. In some embodiments, the adjustable leveling assembly further comprises a transmission device operatively arranged to transmit data to a remote location.

According to aspects illustrated herein, there is provided an adjustable leveling assembly for a feeder tray of a printer, comprising a body, including a top surface including an aperture, a bottom surface operatively arranged to engage the feeder tray, a first side wall extending from the top surface to the bottom surface, and a second side wall extending from the top surface to the bottom surface, the second side wall spaced apart from the first side wall, and a first wedging element slidably connected to the body, extending through the aperture, and operatively arranged to engage a stack of sheets.

In some embodiments, the first wedging element comprises a first cross-member engaged with the first side wall and the second side wall, a second cross-member engaged with the first side wall and the second side wall, and at least one surface that extends between the first cross-member and the second cross-member, in some embodiments, the at least one surface comprises at least one of a planar surface and a curvilinear surface. In some embodiments, the first cross-member and the second cross-member are arranged below the top surface, and the at least one surface is arranged at least partially above the top surface. In some embodiments, the adjustable leveling assembly further comprises a first channel connected to the first side wall and a second channel connected to the second side wall, wherein the first wedging element is engaged with the first channel and the second channel via at least one roller. In some embodiments, the adjustable leveling assembly further comprises a third channel connected to the first side wall, a fourth channel connected to the second side wall, and a second wedging element engaged with the third channel and the fourth channel.

According to aspects illustrated herein, there is provided an adjustable leveling feeder tray, comprising a body, including a top surface, a bottom surface, a first side wall extending from the top surface to the bottom surface, and a second side wall extending from the top surface to the bottom surface, the second side wall spaced apart from the first side wall, and a first wedging element slidably connected to the body, including a first cross-member, a second cross-member, and at least one surface that extends between the first cross-member and the second cross-member, wherein the at least one surface comprises at least one of a planar surface and a curvilinear surface.

According to aspects illustrated herein, there is provided a smart specialty media feeding kit with variable geometry surfaces. The assembly enables specialty media, such as cards, or other additions to the paper surface such as labels, to feed from the tray by changing the geometry of the stack in the feeder tray. The top surface of the pile height of paper is leveled by using a platform placed underneath the stack along with adjustable curved supports underneath the media.

The assembly comprises a rectangular platform and a variety of different shaped curved props and supports that can be moved into an almost infinite number of places or locations on the main platform. Cutouts in the main platform allow the supports to slide into almost any position under the media. The shapes of the curved supports are designed to correct various different types of stacks of media to make the top surface of the stack flat.

The assembly further comprises a wireless component, or a wireless transponder or transmitter, achievable via BLUETOOTH® wireless technology or other radiofrequency identification (RFID) technique, that communicates to a tablet or small screen placed next to the digital front end of the printing device or anywhere else convenient. The screen indicates that the leveling device is installed in the feeder tray (e.g., the screen may display a message: "Smart Feeding Kit Installed. Monitor output at Stacker."). This warning may be necessary because at present, the same paper geometry that hinders feeding (the stack of media prior to entering the printing device, or input) also prevents stacking (the stack of media after exiting the printing device, or output). The user must remember that the capacity for stacking is very limited; even if the user can now place several hundred sheets in the feeder tray by using the smart feeding kit, the sheets in the stacker will be uneven and they will have to unload the sheets while the printing device is running.

The smart feeding kit or assembly is operatively arranged to be placed into any feeder tray of a printing device. In some embodiments, the curved supports or wedging elements can be stored inside the main platform of the kit or assembly. As such, various sized supports can, at the same time, be housed and utilized by the main platform.

In some embodiments, the kit or assembly allows feeding business card stocks and media with irregular thickness in stacks (e.g., multiplatform identification (ID) cards, index inkjet treated ID cards, and any other stocks that will have irregular stack properties). The assembly of the present disclosure enables feeding over 400 sheets at a time into the feeder tray as well long-edge feeding. In some embodiments, the assembly comprises a plurality of peak shapes that can be adjusted to any location on the body surface (i.e., slides linearly there along). In some embodiments, the assembly further comprises a wireless transmission device to alert the user to monitor the output stacker (i.e., the irregular thickness stock will stack uneven in the output stacker and thus must be monitored). The wireless transmission device further communicates its location in the printing device.

These and other objects, features, and advantages of the present disclosure will become readily apparent upon a review of the following detailed description of the disclosure, in view of the drawings and appended claims.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION

Figure 1:
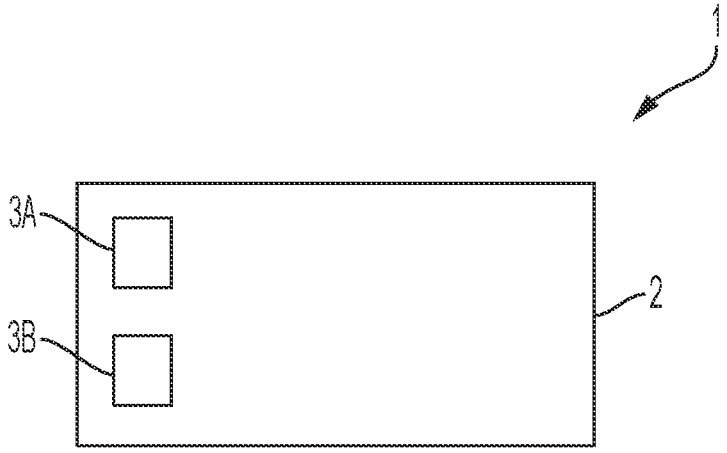
FIG. 1 PRIOR ART
FIG. 1 is a top elevational view of a prior art specialty sheet.

At the outset, it should be appreciated that like drawing numbers on different drawing views identify identical, or functionally similar, structural elements. It is to be understood that the claims are not limited to the disclosed aspects.

Furthermore, it is understood that this disclosure is not limited to the particular methodology, materials and modifications described and as such may, of course, vary. It is also understood that the terminology used herein is for the purpose of describing particular aspects only, and is not intended to limit the scope of the claims.

Unless defined otherwise, all technical and scientific terms used herein have the same meaning as commonly understood to one of ordinary skill in the art to which this disclosure pertains. It should be understood that any methods, devices or materials similar or equivalent to those described herein can be used in the practice or testing of the example embodiments. The assembly of the present disclosure could be driven by hydraulics, electronics, pneumatics, and/or springs.

It should be appreciated that the term "substantially" is synonymous with terms such as "nearly," "very nearly," "about," "approximately," "around," "bordering on," "close to," "essentially," "in the neighborhood of," "in the vicinity of," etc., and such terms may be used interchangeably as appearing in the specification and claims. It should be appreciated that the term "proximate" is synonymous with terms such as "nearby," "close," "adjacent," "neighboring," "immediate," "adjoining," etc., and such terms may be used interchangeably as appearing in the specification and claims. The term "approximately" is intended to mean values within ten percent of the specified value.

It should be understood that use of "or" in the present application is with respect to a "non-exclusive" arrangement, unless stated otherwise. For example, when saying that "item x is A or B," it is understood that this can mean one of the following: (1) item x is only one or the other of A and B; (2) item x is both A and B. Alternately stated, the word "or" is not used to define an "exclusive or" arrangement. For example, an "exclusive or" arrangement for the statement "item x is A or B" would require that x can be only one of A and B. Furthermore, as used herein, "and/or" is intended to mean a grammatical conjunction used to indicate that one or more of the elements or conditions recited may be included or occur. For example, a device comprising a first element, a second element and/or a third element, is intended to be construed as any one of the following structural arrangements: a device comprising a first element; a device comprising a second element; a device comprising a third element; a device comprising a first element and a second element; a device comprising a first element and a third element; a device comprising a first element, a second element and a third element; or, a device comprising a second element and a third element.

Moreover, as used herein, the phrases "comprises at least one of" and "comprising at least one of" in combination with a system or element is intended to mean that the system or element includes one or more of the elements listed after the phrase. For example, a device comprising at least one of: a first element; a second element; and, a third element, is intended to be construed as any one of the following structural arrangements: a device comprising a first element; a device comprising a second element; a device comprising a third element; a device comprising a first element and a second element; a device comprising a first element and a third element; a device comprising a first element, a second element and a third element; or, a device comprising a second element and a third element. A similar interpretation is intended when the phrase "used in at least one of:" is used herein. Furthermore, as used herein, "and/or" is intended to mean a grammatical conjunction used to indicate that one or more of the elements or conditions recited may be included or occur. For example, a device comprising a first element, a second element and/or a third element, is intended to be construed as any one of the following structural arrangements: a device comprising a first element; a device comprising a second element; a device comprising a third element; a device comprising a first element and a second element; a device comprising a first element and a third element; a device comprising a first element, a second element and a third element; or, a device comprising a second element and a third element.

"Printer," "printer system," "printing system," "printer device," "printing device," and "multi-functional device (MFD)" as used herein encompass any apparatus, such as a digital copier, bookmaking machine, facsimile machine, multi-function machine, etc., which performs a print outputting function for any purpose.

Furthermore, as used herein, "sheet," "web," "substrate," "printable substrate," and "media" refer to, for example, paper, transparencies, parchment, film, fabric, plastic, photo-finishing papers, or other coated or non-coated substrate media in the form of a web upon which information or markings can be visualized and/or reproduced. By specialty sheet it is meant a sheet which includes a card, label, sticker, or other element that is thicker than the substrate on or in which it resides.

"Removable mechanical modification" refers to any mechanical device or object that can be installed or removed from a printer incidental to a need to print a particular print job.

Referring now to the figures, FIG. 1 is a top elevational view of prior art specialty sheet 1. As shown, specialty sheet 1 comprises substrate 2 and at least one card or label or sticker, for example, cards 3A-B. Cards 3A-B have a thickness that is greater than substrate 2.

Figure 2A:
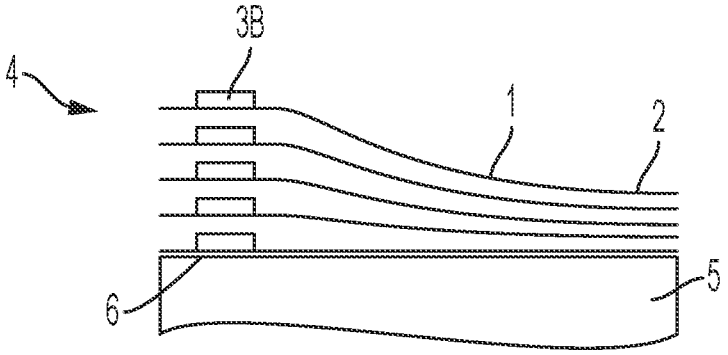
FIG. 2A PRIOR ART
FIG. 2A is a side elevational view of a prior art stack of specialty sheets arranged on a feeder tray.

FIG. 2A is a side elevational view of a prior art stack of specialty sheets 1 arranged on feeder tray 5 of a printing device. As shown, a plurality of specialty sheets 1 are stacked on top of each other forming stack 4 on surface 6 of feeder tray 5. Because cards 3A-B have a greater thickness than substrate 2, stack 4 comprises an uneven geometry, which causes feeding issues.

Figure 2B:
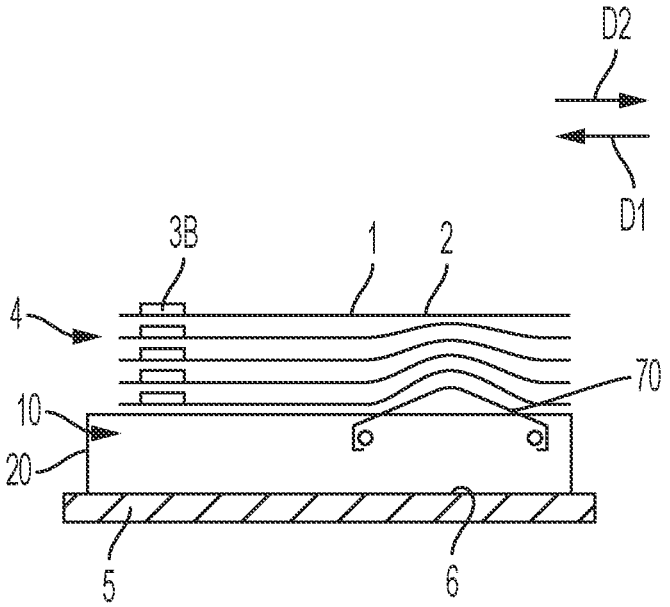
FIG. 2B is a cross-sectional schematic view of the printing device taken generally along line 2B-2B in FIG. 6.
Figure 6:
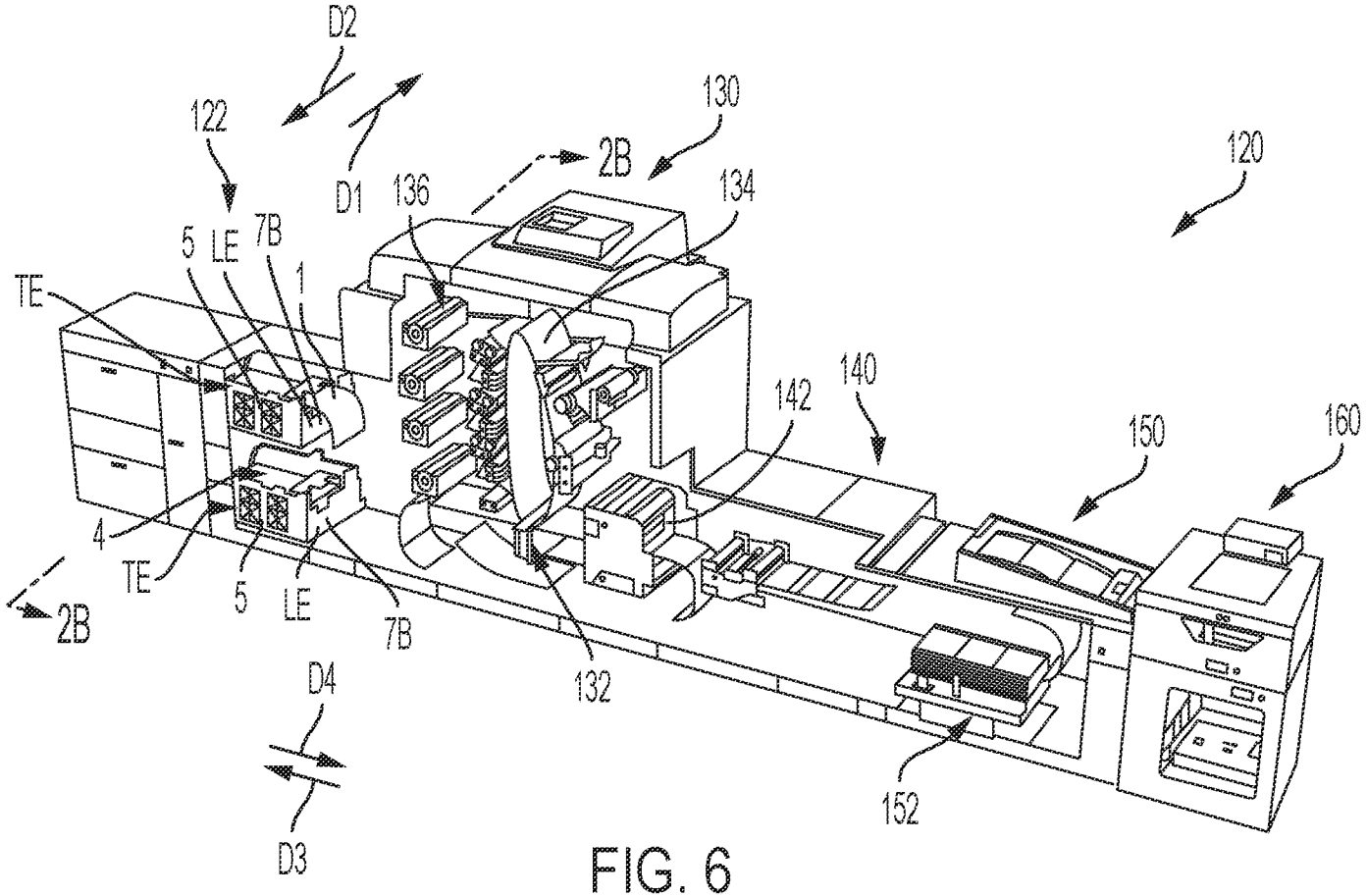
FIG. 6 is a partial perspective view of a printing device.

FIG. 2B is a cross-sectional schematic view of printing device 120 taken generally along line 2B-2B in FIG. 6. As shown, feeder tray 5 is modified by the arrangement of adjustable leveling assembly 10 on surface 6 (i.e., a removable mechanical modification). After arranging adjustable leveling assembly 10 on feeder tray 5, wedging element 70 is adjusted in direction D4 such that stack 4 is substantially level at its top sheet. As shown, wedging element 70 is displaced in direction D2 to offset the excessive elevation of stack 4 created by cards 3B. It should be appreciated that such a removable mechanical modification can also be implemented in stacker 152 (see FIG. 6) for example, with a second adjustable wedging element 10. Stack 4 as shown in FIG. 2B is said to be level. By level stack or level, it is meant that the top sheet 1 of stack 4 is parallel or substantially parallel to surface 6 or feeder tray 5. As previously described, such a level stack corrects any issues with sheet feeding (input) or stacking (output) caused by an unlevel stack. In some embodiments, wedging element 70 is slidably connected to feeder tray 5 along a direction perpendicular to sheet feeding or movement, namely, in direction D1 and direction D2, with direction D4 being the direction of paper feeding. In some embodiments, wedging element 70 is slidably connected to feeder tray 5 along a direction of or parallel to sheet feeding or movement, namely, in direction D3 and direction D4, with direction D4 being the direction of paper feeding.

Figure 3A:
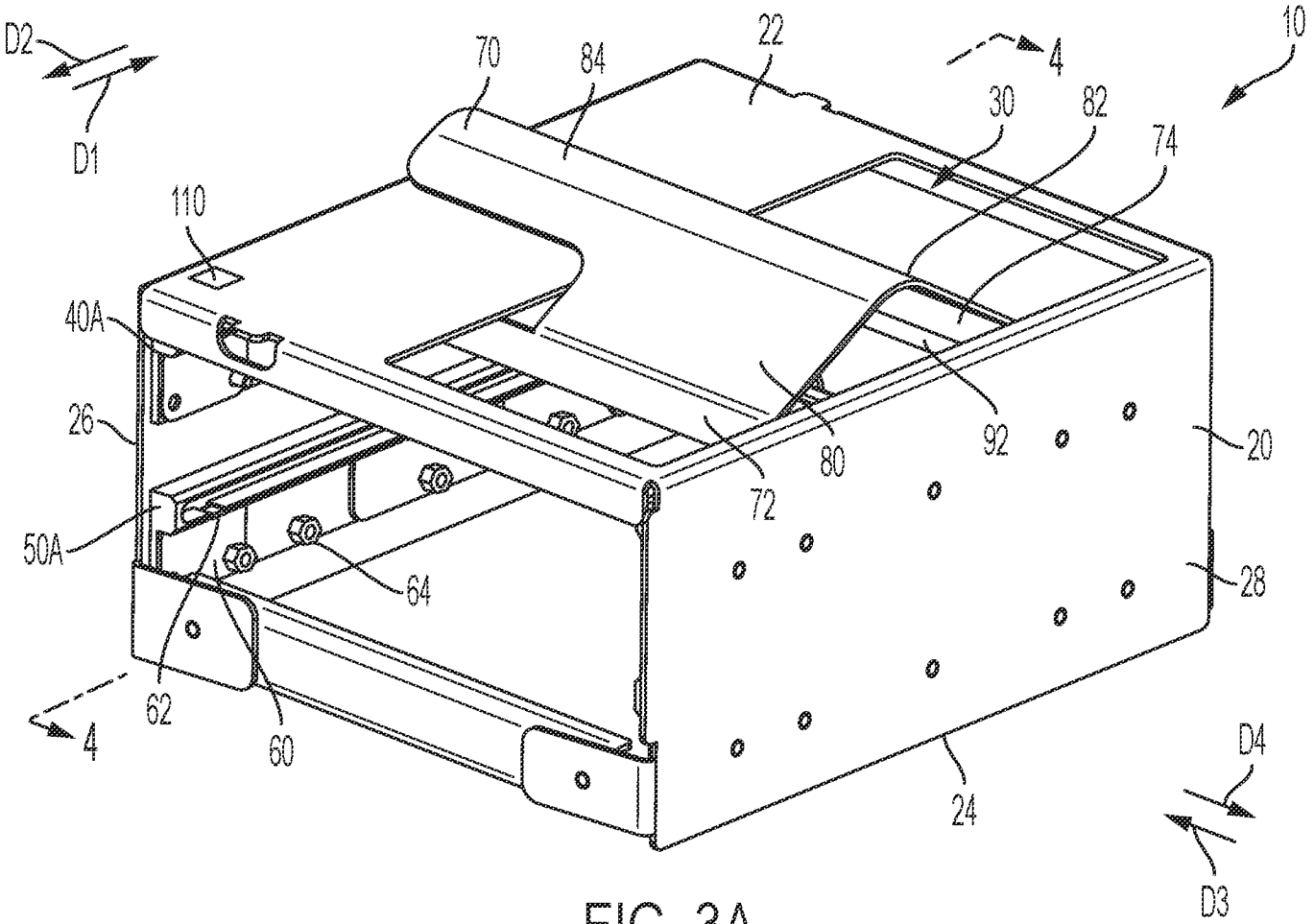
FIG. 3A is a front top perspective view of an adjustable leveling assembly.
Figure 3B:
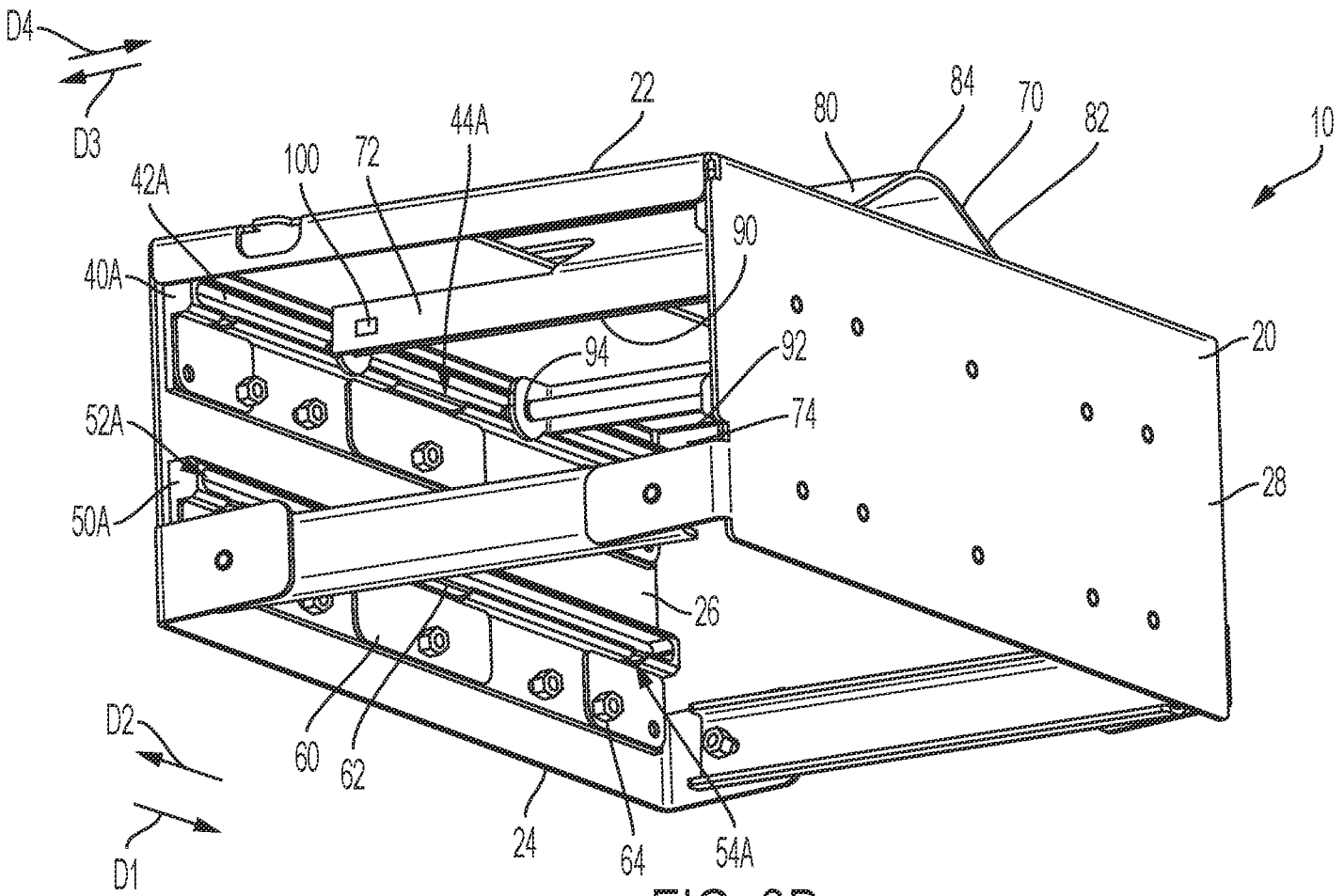
FIG. 3B is a front bottom perspective view of the adjustable leveling assembly shown in FIG. 3A.
Figure 3C:
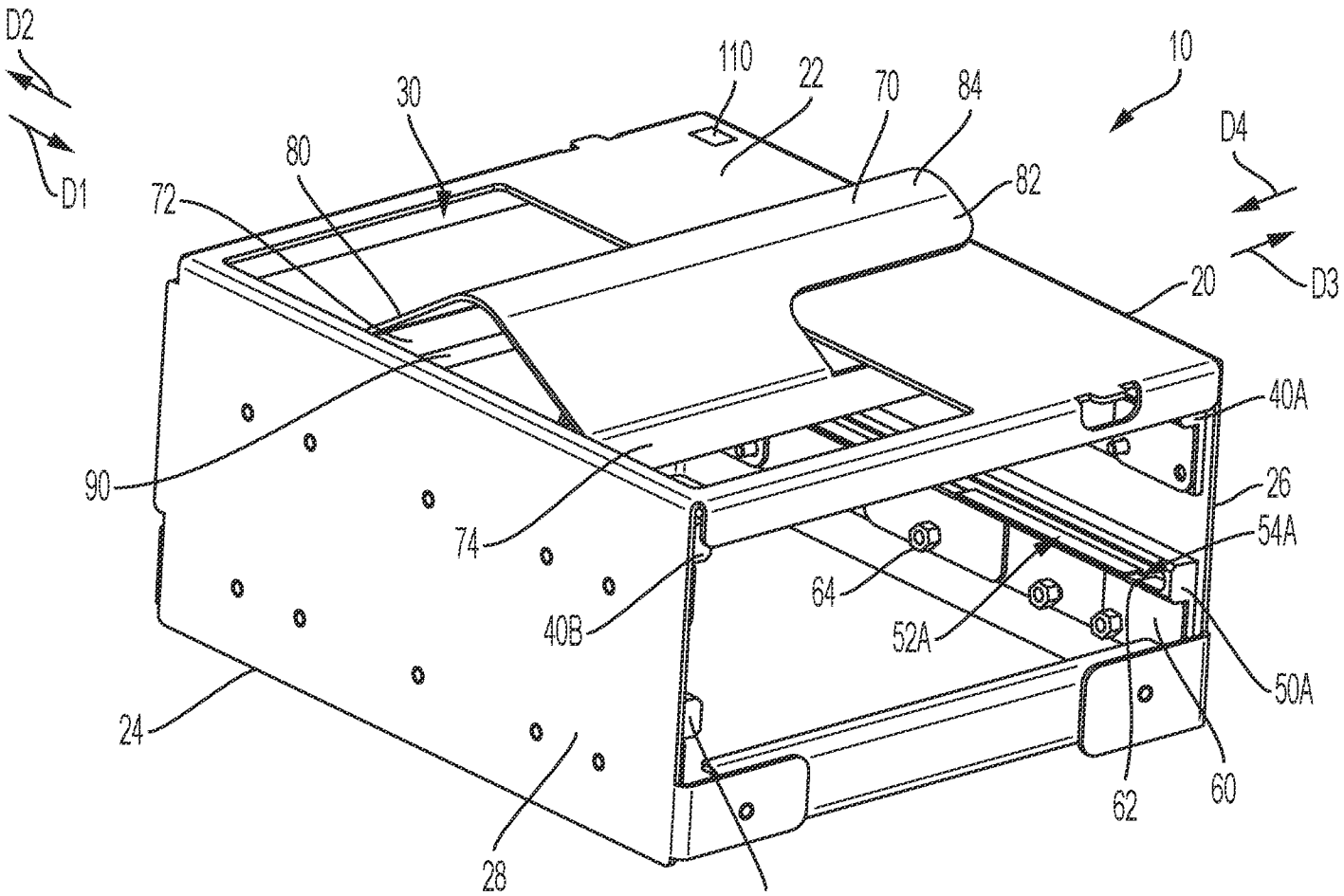
FIG. 3C is a rear top perspective view of the adjustable leveling assembly shown in FIG. 3A.
Figure 4:
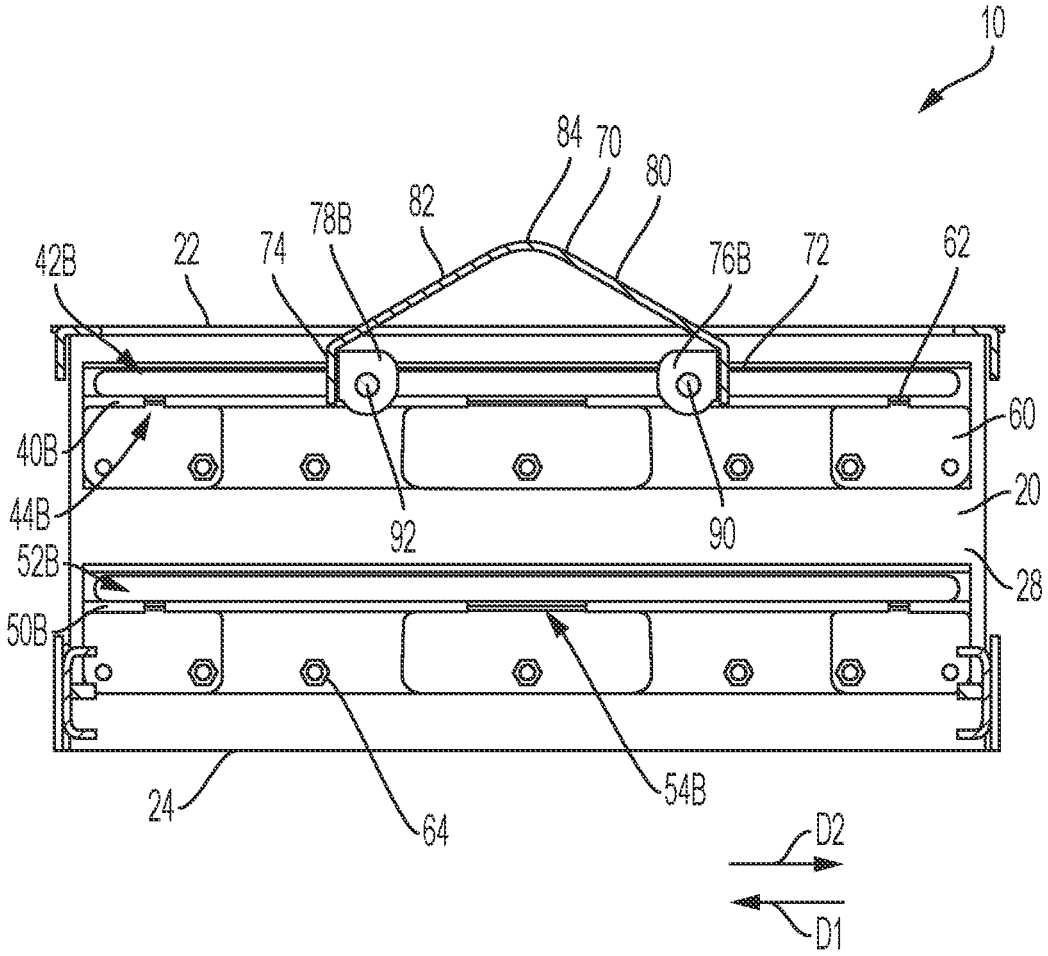
FIG. 4 is a cross-sectional view of the adjustable leveling assembly taken generally along line 4-4 in FIG. 3A.

FIG. 3A is a front top perspective view of adjustable leveling assembly 10. FIG. 3B is a front bottom perspective view of adjustable leveling assembly 10. FIG. 3C is a rear top perspective view of adjustable leveling assembly 10. FIG. 4 is a cross-sectional view of adjustable leveling assembly 10 taken generally along line 4-4 in FIG. 3A. The following descriptions should be read in view of FIGS. 1-4.

Body 20 comprises top surface 22, bottom surface 24, side wall 26, and side wall 28. Bottom surface 24 is operatively arranged to engage, or be placed on top of, surface 6 of feeder tray 5 of a printing device. In some embodiments, bottom surface 24 is operatively arranged to be removably connected to top surface 6 of feeder tray 5. Top surface 22 is arranged substantially parallel to bottom surface 24 to engage a plurality of specialty sheets 1, namely, stack 4. In some embodiments, top surface 22 is arranged unparallel to bottom surface 24. Side wall 26 extends top surface 22 to bottom surface 24. Side wall 26 is connected to top surface 22 and bottom surface 24. In some embodiments, side wall 26 is fixedly secured to top surface 22 and bottom surface 24. Body 20 is generally box-shaped or shaped like a rectangular prism or cube, with open ends. However, it should be appreciated that the overall height of body 20 (i.e., the height of side walls 26 and 28) may be increased or decreased based on the printing device. Additionally, the dimensions of top surface 22 (i.e., length and width) may be adjusted for various size sheets (e.g., A0, A1, A2, letter, legal, tabloid, etc.). Top surface 22 comprises aperture 30. Aperture 30 is operatively arranged to engage wedging element 70 such that surfaces 80, 82, 84 protrude through top surface 22, as will be described in greater detail below.

In some embodiments, adjustable leveling assembly 10 further comprises tracks 40A-B and 50A-B. Track 40A is connected to side wall 26 and comprises channel 42A. Channel 42A is operatively arranged to engage wedging element 70, specifically rollers or axels 90 and 92, as will be described in greater detail below. In some embodiments, channel 42A comprises one or more spaces 44A. Spaces 44A allow rollers 90 and 92 to disengage channels 42A such that wedging element 70 can be removed from track 40A.

Track 40B is connected to side wall 28 and comprises channel 42B. Channel 42B is operatively arranged to engage wedging element 70, specifically rollers or axels 90 and 92, as will be described in greater detail below. In some embodiments, channel 42B comprises one or more spaces 44B. Spaces 44B allow rollers 90 and 92 to disengage channels 42B such that wedging element 70 can be removed from track 40B.

Track 50A is connected to side wall 26 and comprises channel 52A. Channel 52A is operatively arranged to engage wedging element 70, specifically rollers or axels 90 and 92, as will be described in greater detail below. In some embodiments, channel 52A comprises one or more spaces 54A. Spaces 54A allow rollers 90 and 92 to disengage channels 52A such that wedging element 70 can be removed from track 50A.

Track 50B is connected to side wall 28 and comprises channel 52B. Channel 52B is operatively arranged to engage wedging element 70, specifically rollers or axels 90 and 92, as will be described in greater detail below. In some embodiments, channel 52B comprises one or more spaces 54B. Spaces 54B allow rollers 90 and 92 to disengage channels 52B such that wedging element 70 can be removed from track 50B.

Tracks 40A and 40B are aligned and are operatively arranged to slidingly engage the "in-use" wedging element or wedging elements 70. By "in-use" it is meant that wedging element 70 protrudes through top surface 22 to engage sheets arranged thereon. Tracks 50A and 50B are aligned and are operatively arranged to slidingly engage the "stored" wedging element or wedging elements 170 and/or 270 (see FIG. 5). By "stored" it is meant that wedging element 170, 270 does not protrude through top surface 22, but rather resides completely between top surface 22 and bottom surface 24. In some embodiments, tracks 40A-B and 50A-B are connected to side walls 26 and 28 via bolts and nuts 64. It should be appreciated, however, that tracks 40A-B and 50A-B can be connected to side walls 26 and 28 via any suitable means, for example, screws, rivets, nails, pins, dowels, soldering, welding, adhesives, etc. It should also be appreciated that in some embodiments that tracks 40A-B and 50A-B are integrally formed with or in side walls 26 and 28 (i.e., channels that tracks 42A-B and 52A-B can be arranged directly in side walls 26 and 28).

In some embodiments, adjustable leveling assembly 10 further comprises one or more plates 60. Each of plates 60 comprises flange 62. Plates 60 are operatively arranged to be removably secured to side walls 26 and 28, or more specifically to tracks 40A-B and 50A-B, to block spaces 44A-B and 54A-B. For example, a user will select the wedging element with the desired dimensions and geometry, for example wedging element 70. Wedging element 70 is then inserted into in-use tracks 40A-B, specifically, into channels 42A-B through spaces 44A-B. Once rollers 90 and 92 are engaged with channels 42A-B, one or more plates 60 are secured to side walls 26 and 28, or tracks 40A and 40B, such that flanges 64 block spaces 44A-B to trap rollers 90 and 92 in channels 42A-B. The width of flanges 64 should be substantially equal to or just less than the width of spaces 44A-B to ensure that rollers 90 and 92 do not inadvertently fall out of channels 42A-B.

Similarly, the non-selected wedging elements are placed in stored tracks 50A-B, specifically in channels 52A-B through spaces 54A-B. Plates 60 are then secured to side walls 26 and 28, or tracks 50A and 50B, such that flanges 64 block spaces 54A-B to trap rollers 90 and 92 in channels 52A-B. The width of flanges 64 should be substantially equal to or just less than the width of spaces 54A-B to ensure that rollers 90 and 92 do not inadvertently fall out of channels 52A-B. Plates 64 can be removably connected to side walls 26 and 28, or tracks 50A and 50B, via any suitable means, for example, bolts, screws, nails, pegs, dowels, pins, rivets, snaps, etc.

Wedging element 70 is slidingly engaged with body 20. Wedging element 70 comprises cross-member 72, cross-member 74, and surfaces 80, 82, and 84. Cross-member 72 is slidingly engaged with side wall 26 and side wall 28, specifically, track 40A and track 40B. In some embodiments, cross-member 72 comprises flange 76A on a first end thereof and flange 76B on a second end thereof. In some embodiments, flange 76A is arranged perpendicular to cross-member 72. In some embodiments, flange 76A is arranged non-perpendicular to cross-member 72. In some embodiments, flange 76A extends in direction D1 or direction D2 from cross-member 72. In some embodiments, flange 76B is arranged perpendicular to cross-member 72. In some embodiments, flange 76B is arranged non-perpendicular to cross-member 72. In some embodiments, flange 76B extends in direction D1 or direction D2 from cross-member 72. Flange 76A and flange 76B comprise through-bore 77A and through-bore 77B, respectively.

Cross-member 74 is slidingly engaged with side wall 26 and side wall 28, specifically, track 40A and track 40B. In some embodiments, cross-member 74 comprises flange 78A on a first end thereof and flange 78B on a second end thereof. In some embodiments, flange 78A is arranged perpendicular to cross-member 74. In some embodiments, flange 78A is arranged non-perpendicular to cross-member 74. In some embodiments, flange 78A extends in direction D1 or direction D2 from cross-member 74. In some embodiments, flange 78B is arranged perpendicular to cross-member 74. In some embodiments, flange 78B is arranged non-perpendicular to cross-member 74. In some embodiments, flange 78B extends in direction D1 or direction D2 from cross-member 74. Flange 78A and flange 78B comprise through-bore 79A and through-bore 79B, respectively.

Surface 80 is connected to and extends from cross-member 72. Surface 80 comprises length L1 and is arranged at angle $\alpha$ relative to cross-member 72 (i.e., a horizontal plane drawn between cross-members 72 and 74). In some embodiments, surface 80 is planar. In some embodiments, surface 80 is curvilinear. It should be appreciated that length L1 and angle $\alpha$ of surface 80, as well as its geometry (e.g., planar, curvilinear, or both planar and curvilinear) can be adjusted for any unlevel geometry of stack 4. In some embodiments, and as shown, surface 80 comprises cutout 81 extending from a first end thereof in direction D4. Cutout 81 allows wedging element 70 to engage top surface 22. Thus, top surface 22 engages cutout 81 such that wedging element 70 can slide or displace relative to body 20 (i.e., surface 80 is arranged above top surface 22 and cross-member 72 is arranged below top surface 22).

Surface 82 is connected to and extends from cross-member 74. Surface 82 comprises length L2 and is arranged at angle $\beta$ relative to cross-member 74 (i.e., a horizontal plane drawn between cross-members 72 and 74). In some embodiments, surface 82 is planar. In some embodiments, surface 82 is curvilinear. It should be appreciated that length L2 and angle $\beta$ of surface 82, as well as its geometry (e.g., planar, curvilinear, or both planar and curvilinear) can be adjusted for any unlevel geometry of stack 4. In some embodiments, length L2 is equal to length L1. In some embodiments, length L2 is not equal to length L1. In some embodiments, angle $\beta$ is equal to angle $\alpha$. In some embodiments, angle $\beta$ is not equal to angle $\alpha$. In some embodiments, and as shown, surface 82 comprises cutout 83 extending from a first end thereof in direction D4. Cutout 83 allows wedging element 70 to engage top surface 22. Thus, top surface 22 engages cutout 83, and cutout 81, such that wedging element 70 can slide or displace relative to body 20 (i.e., surface 82 is arranged above top surface 22 and cross-member 74 is arranged below top surface 22).

Surface 84 is connected to and extends from surface 80 and surface 82. In some embodiments, surface 84 is curvilinear and comprises radius R. In some embodiments, surface 84 is planar. Surface 84 forms the peak or the highest point of wedging element 70. It should be appreciated that the dimensions of wedging element 70, namely, length L1, length L2, radius R, angle $\alpha$, angle $\beta$, and the geometry of surfaces 80, 82, and 84 are to be chosen such that when stack 4 is arranged on wedging element 70 and top surface 22, the top surface of stack 4 is level. This might require a wedging element having two separate and distinct peaks, or a S-shaped geometry.

As shown, cross-members 72 and 74 are arranged below top surface 22 while surfaces 80, 82, and 84 protrude through and extend above top surface 22. This allows specialty sheets 1, or more specifically stack 4, to engage both wedging element 70 and top surface 22. This arrangement also wedging element 70 to be displaced while stack 4 is arranged on adjustable leveling assembly 10 (i.e., stack 4 can be placed on top of surfaces 80, 82, and/or 84 and wedging element 70 can subsequently be adjusted relative to body 20).

As previously described, wedging element 70 is slidingly engaged with body 20 such that wedging element 70 is displaceable in directions D1 and D2 with respect to body. In some embodiments, adjustable leveling assembly 10 comprises rollers or axels 90 and 92. Roller 90 extends through cross-member 72, specifically through-bores 77A-B of flanges 76A-B, respectively, and engages tracks 40A-B. Roller 90 is rotatably connected to wedging element 70, and is secured axially thereto via one or more retaining elements or retaining rings 94. Retaining elements 94 may be arranged in a groove in roller 90. Roller 92 extends through cross-member 74, specifically through-bores 79A-B of flanges 78A-B, respectively, and engages tracks 40A-B. Roller 92 is rotatably connected to wedging element 70, and is secured axially thereto via one or more retaining elements or retaining rings 94 (see FIG. 3B). Retaining elements 94 may be arranged in a groove in roller 90. It should be appreciated that wedging element 70, specifically, cross-members 72 and 74, may be slidingly engaged with body 20 via any suitable means.

In some embodiments, adjustable leveling assembly 10 comprises locking mechanism 100 operatively arranged to lock wedging element 70 with respect to body 20 (see FIG. 3B). In such embodiments, a wedging element having a suitable geometry is selected, for example wedging element 70, and arranged in in-use tracks 40A-B. The non-selected wedging elements, for example wedging elements 170, 270, are arranged in stored tracks 50A-B (see FIG. 5). Wedging element 70 is then displaced in direction D1 or direction D2 with respect to body 20 until positioned in its desired location. Then locking mechanism 100 is engaged to fix wedging element 70 in that position. It should be appreciated that any locking mechanism suitable for temporarily fixing wedging element 70 with respect to body 20 may be used, for example, set screws, bolts, screws, rivets, magnets, cotter pins, retaining rings and elements, friction, etc. It should also be appreciated that in some embodiments, wedging element 70 may be more permanently fixed with respect to body 20 using, for example, adhesives, welding, soldering, etc. Locking mechanism 100 can also be arranged on any component. For example, while locking mechanism 100 is shown arranged on wedging element 70, it can also be arranged on body 20, tracks 40A and/or 40B, or rollers 90 and/or 92. Furthermore, a locking mechanism or mechanisms can be employed to fix the non-selected wedging elements (i.e., wedging elements 170, 270) arranged in the stored tracks 50A-B to body 20.

Figure 5:
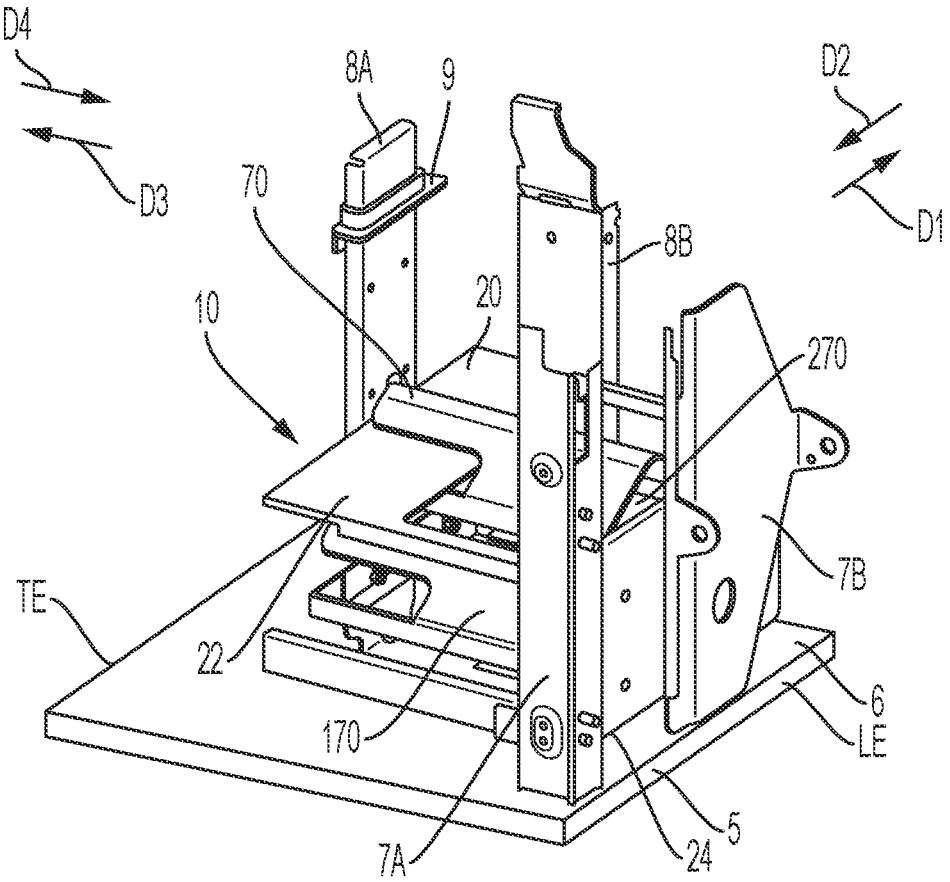
FIG. 5 is a front top perspective view of an adjustable leveling assembly arranged on a feeder tray.

FIG. 5 is a front top perspective view of adjustable leveling assembly 10 arranged on feeder tray 5. As shown, adjustable leveling assembly 10 comprises body 20, one in-use wedging element 70, and two stored wedging elements 170 and 270. Body 20 is arranged such that bottom surface 24 is engaged with feeder tray 5. Bottom surface 24 may be removably connected to, or arranged on top of, surface 6 of feeder tray 5. Feeder tray 5, and specifically the printing device, may comprise static side walls 7A-B, which abut against or are arranged adjacent to body 30. Feeder tray 5, and specifically the printing device, may further comprise movable guides 8A-B. Moveable guide 8A is operatively arranged to displace in directions D3 and D4, and moveable guide 8B is operatively arranged to displace in directions D1 and D2. Static side walls and moveable guides are known in the art and are arranged adjacent feeder tray 5 to maintain alignment of the stack of sheets arranged thereon. Moveable guide 8A may comprise a paper trail edge 9 that indicates the top of the stack of sheets arranged on feeder tray 5. The sheets in the stack are fed to the printing device in direction D4, over the top of static side wall 7B.

Adjustable leveling assembly 10 arranged on surface 6 of feeder tray 5 and between static side walls 7A-B and moveable guides 8A-B. As previously described, the dimensions of body 20, specifically top surface 22, are chosen to correspond to the sheet size to be arranged thereon (e.g., A3, A4, A5, letter, etc.). The dimensions and geometry (e.g., length L1, length L2, radius R, angle $\alpha$, angle $\beta$, etc.) of the in-use wedging element 70 are chosen based on the curvature or unlevel geometry of stack 4 such that, when stack 4 is arranged on wedging element 70 and tup surface 22, the top of stack 4 is level or otherwise planar.

Stored wedging elements 170 and 270 are substantially similar to wedging element 70 with respect to its elements; however, wedging elements 170 and 270 are different from wedging element 70 with respect to their dimensions and geometry. Since wedging elements 70, 170, and 270 each differ in dimensions and geometry from each other, a user can select a wedging element for specific specialty sheets 1. For example, the user would select the wedging element that, when specialty sheets 1 are arranged thereon, results in a level top surface of stack 4. The other wedging elements can be stored on tracks 50A-B. It should be further appreciated that a user may select two in-use wedging elements. In such embodiments, two wedging elements are arranged in tracks 40A-B to create a custom curvature, for example, having two peaks.

In some embodiments, adjustable leveling assembly 10 further comprises wireless communication device or transponder or transmitter or transmission device 110. Wireless communication device 110 is operatively arranged to transmit data to a remote location. In some embodiments, the transmitted data indicates the location of adjustable leveling assembly 10 geographically. In some embodiments, the transmitted data indicates which printing device or feeder tray adjustable leveling assembly is arranged in. This is desirable because a single location (i.e., building) may have a plurality of printing devices but only one adjustable leveling assembly 10. As such, it is desirable for users to know which printing device already incorporates adjustable leveling assembly 10 (i.e., if the user needs to print specialty sheets, the user can utilize that specific printer since adjustable leveling assembly 10 is already there). In some embodiments, the transmitted data indicates that the user must attend to the stacker of the printing device, the stacker being the device that stacks the printed sheets, or the output of the printing device. Specialty sheets 1 will again be compiled into a stack at the output stacker of the printing device and thus exhibit an uneven geometry. As such, the user must remove the specialty sheets 1 from the stack during printing to prevent the stack from getting too high. The data may be transmitted to a cellular device or tablet, a computing device, and/or the graphic user interface or digital front end of the printing device.

It should be appreciated that in some embodiments, adjustable leveling assembly 10 is fixedly secured to or integrally formed with feeder tray 5. Put another way, in such embodiments feeder tray 5 of a printing device incorporates adjustable leveling assembly 10 therein such that top surface 22 can be used for regular sheets without wedging elements 70, 170, 270 and for specialty sheets with wedging elements 70, 170, 270.

FIG. 6 is a partial perspective view of printing device 120. In some embodiments, printing unit 120 may be, for example, a XEROX® IGEN® printer, XEROX® BRENVA® printer, or XEROX® BALTORO® printer. Generally, printing device 120 comprises feeder module 122, print engine tower 130, fuser module 140, and output module 150. In some embodiments, printing device 120 further comprises finishing or post process module 160. The substrate or printable media travels through printing device 120 in direction D4.

Feeder module 122 feeds substrates into print engine tower 130. Feeder module 122 comprises one or more feeder trays 5. Feeder trays 5 of feeder module 122 can be modified, for example, with adjustable leveling assembly 10 as described above.

Print engine tower 130 comprises one or more dry ink dispensers, for example, dry ink dispensers 136, and transfer belt 134. Although a xerographic (i.e., toner) print engine is shown, adjustable leveling assembly 10 and the method of managing removable modifications to a printing device of the present disclosure can be used in wet ink (i.e., ink jet) or other printing technologies. In some embodiments, print engine tower 130 further comprises image transfer device 132. Some embodiments, e.g., embodiments including image formation by a dry ink, may benefit by printing systems that include what is known as an acoustic transfer assist (ATA) device. One of ordinary skill in the art will appreciate that printing systems that use a flexible belt in the process of forming an image thereon and subsequently transferring that image from the flexible belt to print media sometimes include one or more ATA devices. ATA devices use acoustic energy to drive the dry ink, e.g., toner, from the belt to the print media. Thus, in some embodiments, image transfer device 132 is an ATA device that assists with transferring a dry ink from a belt to the malleable print media so that no direct contact between the belt and malleable material is necessary. It should be appreciated that such an arrangement may minimize image defects and thereby increase image quality. However, it should also be appreciated that conventional transfer of ink or marking material from a drum or other solid object is also possible.

Fuser module 140 comprises fuser 142. Fuser 142 applies heat and/or pressure to the printable media or specialty sheet 1 to fuse dry ink to substrate 2, card 3A, and/or card 3B. In some embodiments, fuser 142 comprises two rollers through which specialty sheet 1 is passed through. Print engine tower 130 and fuser module 140 apply or "print" and fuse ink onto substrate 2, card 3A, and/or card 3B.

Output module 150 presents the finished printable media for retrieval. Output module 150 comprises stacker 152 that stacks the finished sheets, for example, specialty sheets 1.

Finishing module 160 applies various finishing details to the print job, for example, stappling, hole punching, binding, lamination, etc.

Figure 7:
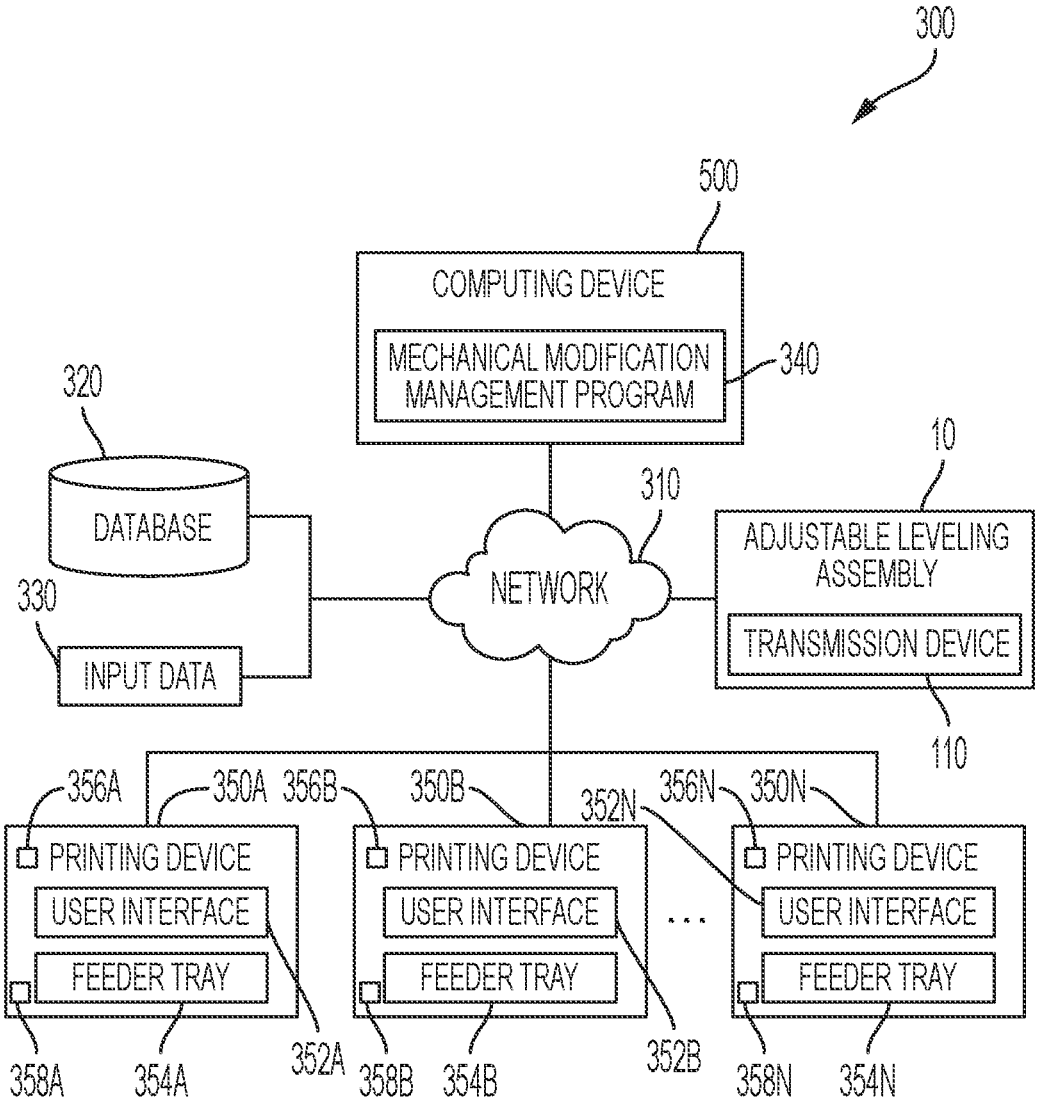
FIG. 7 is a functional block diagram illustrating an environment, in accordance with some embodiments of the present disclosure.

FIG. 7 is a functional block diagram illustrating removable mechanical modification management environment 300, in accordance with some embodiments of the present disclosure. FIG. 7 provides only an illustration of one implementation, and does not imply any limitations with regard to the environments in which different embodiments may be implemented. Many modifications to the depicted environment may be made by those skilled in the art without departing from the scope of the disclosure as recited by the claims. In some embodiments, removable mechanical modification management environment 300 includes computing device 500, database 320, input data 330, and at least one printing device, for example, printing devices 350A, 350B, . . . 350N (printing devices 350A-N), all of which are connected to network 310. In some embodiments, removable mechanical modification management environment 300 further comprises adjustable leveling assembly 10. In some embodiments, printing devices 350A, 350B, . . . 350N and/or adjustable leveling assembly 10 communicate with computing device 500 and/or removable mechanical modification management program 340.

Network 310 can be, for example, a local area network (LAN), a wide area network (WAN) such as the Internet, or a combination of the two, and can include wired, wireless, or fiber optic connections.

Computing device 500 may be a hardware device that receives an input related to a removable mechanical modification of a printing device. In some embodiments, the input comprises a notification that a printing device has been mechanically modified. For example, if a feeder tray of a printing device has been modified to include adjustable leveling assembly 10, then removable mechanical modification management program 340 receives a notification of such modification and stores the information, for example, on database 320. In some embodiments, the input comprises a request for a location of a removable mechanical modification. For example, it is desirable for a user to determine where adjustable leveling assembly 10 is installed (i.e., which printing device adjustable leveling assembly 10 is arranged in). Therefore, in case of a request for such location removable mechanical modification management program 340 determines the location and provides the location to the user. Computing device 500 is capable of communicating with network 310, database 320, input data 330, printing devices 350A-N, and/or adjustable leveling assembly 10. In some embodiments, computing device 500 may include a computer. In some embodiments, computing device 500 may include internal and external hardware components, as depicted and described in further detail with respect to FIG. 9. In some embodiments, removable mechanical modification management program 340 is implemented on a web server, which may be a management server, a web server, or any other electronic device or computing system capable of receiving and sending data. The web server can represent a computing system utilizing clustered computers and components to act as a single pool of seamless resources when accessed through a network. The web server may include internal and external hardware components, as depicted and described in further detail with respect to FIG. 9.

Removable mechanical modification management program 340 receives inputs in the form of data to be stored or a request for information. Removable mechanical modification management program 340 can receive data from printing devices 350A-N, adjustable leveling assembly 310, and/or input data 330 and store it in database 320. As will be described in greater detail below, input data 330 can be data input into removable mechanical modification management environment 330 via another source (e.g., from a user's cellular device, a tracking system, a scheduling program, a global positioning system (GPS), etc.). Removable mechanical modification management program 340 communicates with database 320 to determine the location of a removable mechanical modification, for example, the location of adjustable leveling assembly 10. Removable mechanical modification management program 340 also communicates with printing devices 350A-N and/or adjustable leveling assembly 10, specifically transmission device 110, to determine the location of adjustable leveling assembly 10. In some embodiments, removable mechanical modification management program 340 sends one or more alerts indicating that a removable mechanical modification to the feeder tray exists, in some embodiments, removable mechanical modification management program 340 sends one or more notifications to a use to monitor an output stacker of the printing device in which adjustable leveling assembly 10 is installed. Removable mechanical modification management program 340 can generally include any software capable of receiving such inputs related to removable mechanical modifications of printing devices and subsequently storing such information, determining and sending locational information of the modification, and/or sending alerts or notifications according to the present disclosure, and communicating with database 320, input data 330, network 310, printing devices 350A-N, and adjustable leveling assembly 10.

Database 320 is a central storage for removable mechanical modification data. The removable mechanical modification data may include, for example, the type of modification (e.g., installment of adjustable leveling assembly 10 in one of feeder trays 354A, 354B, . . . 354N (hereinafter feeder trays 354A-N), the location of the modification (e.g., in printing device 350B), etc. Database 320 can be implemented using any non-volatile storage medium known in the art. For example, authentication database can be implemented with a tape library, optical library, one or more independent hard disk drives, or multiple hard disk drives in a redundant array of independent disks (RAID).

Input data 330 is data inputted by a user, for example, via a personal computing device (e.g., cellular telephone or smart phone, tablet, etc.). Such data may include the type of removable mechanical modification of a printing device (e.g., adjustable leveling assembly 10 has been installed) and the location of such removable mechanical modification (e.g., printing device 350A, third floor printer, the printing device in building A, etc.). Input data 330 may also include a request for removable mechanical modification data (e.g., a request for the location of adjustable leveling assembly 10).

Printing devices 350A-N are arranged to communicate with computing device 500. Printing devices 350A-N comprise user interfaces 352A, 354B, . . . 354N (hereinafter user interfaces 352A-N) and feeder trays 354A-N, respectively. User interfaces 352A-N may be, for example, graphic user interfaces (GUIs) or touch screens. As such, user interfaces 354A-N allow a user to enter data or an input into removable mechanical modification management environment 300, submit a request for data from removable mechanical modification management environment 300 (i.e., location data), and receive alerts and/or notifications from removable mechanical modification management environment 300. It should be appreciated that, in some embodiments, computing device 500 and removable mechanical modification management program 340 can be implemented within at least one of printing devices 350A-N. That is to say, printing devices 350A-N may have a built-in computing device including removable mechanical modification management program 340 thereon. Furthermore, while FIG. 7 depicts a plurality of printing devices 350A-N, in some embodiments, removable mechanical modification management environment 300 only comprises one printing device. As is known in the art, and as previously described, feeder trays 354A-N hold sheets prior to applying marking material thereto. Contrarily, the output stacker holds sheets after marking material has been applied thereto.

Figure 8:
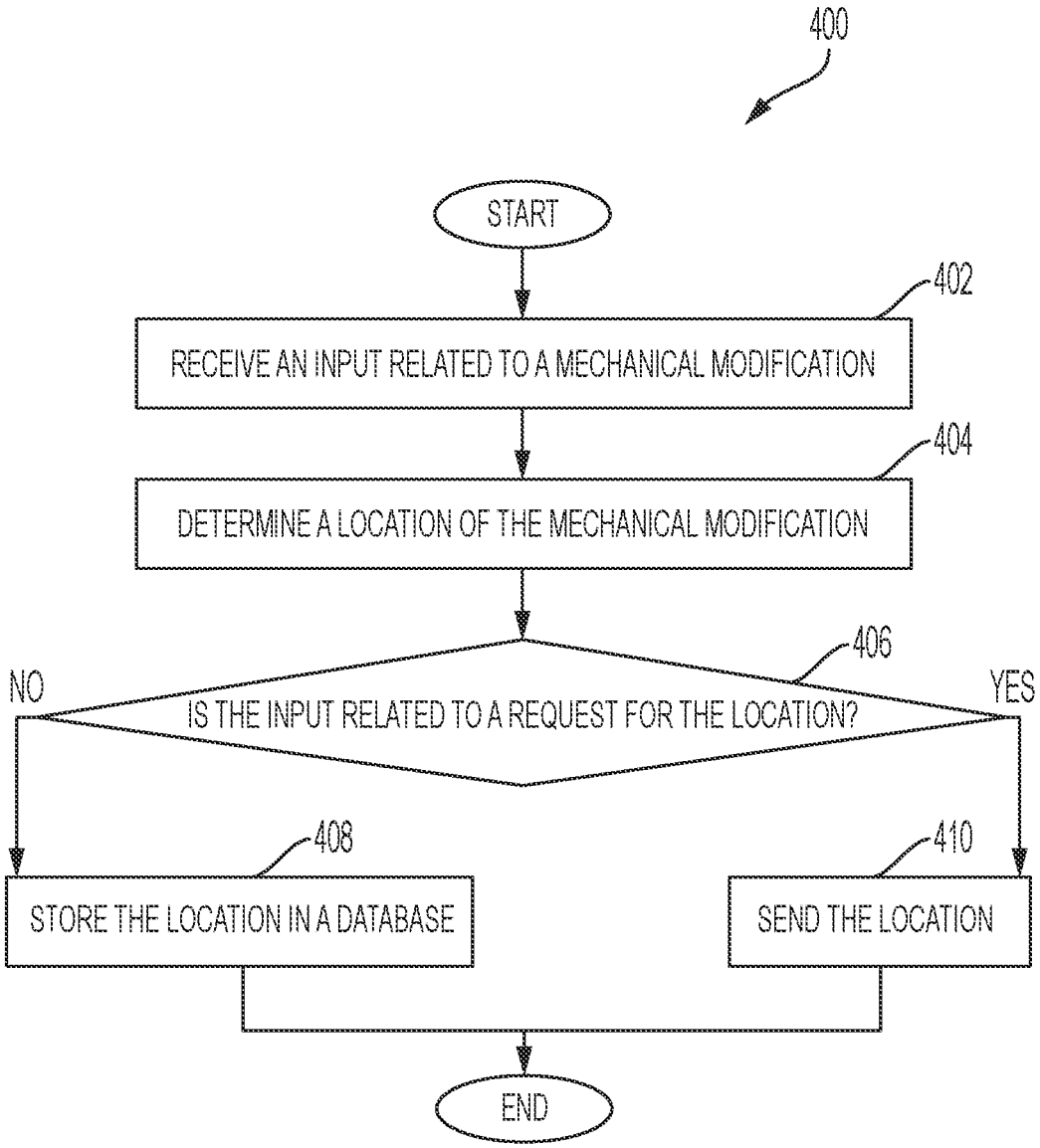
FIG. 8 is a flow chart depicting operational steps for managing removable mechanical modifications in printing devices, in accordance with some embodiments of the present disclosure; and, FIG. 9 is a block diagram of internal and external components of a computer system, in accordance with some embodiments of the present disclosure.

FIG. 8 shows flow chart 400 depicting operational steps for managing removable mechanical modifications in one or more printing devices 350A-N, in accordance with some embodiments of the present disclosure.

In step 402, removable mechanical modification management program 340 receives an input related to a removable mechanical modification. For example, in step 402, removable mechanical modification management program 340 receives an indication that feeder tray 354A has been modified with adjustable leveling assembly 10.

In some embodiments, the input is received from a printing device, for example, 350A, 350B, or 350N. In some embodiments, the input is received from a user interface, for example, 352A, 352B, or 352N. In some embodiments, the input is received from a feeder tray, for example, 354A, 354B, or 354N. In such embodiments, wherein the input is received from a printing device or one of its components, the removable mechanical modification may be manually inputted (e.g., by a user) into the user interface after the removable mechanical modification has been made. In some embodiments, a sensor arranged on or in the printing device, for example, sensor 356A, 356B, or 356N, detects the removable mechanical modification and a transmitter, for example, transmitter 358A, 358B, or 358N, sends a signal related to such removable mechanical modification to removable mechanical modification management program 340.

In some embodiments, the input is received from adjustable leveling assembly 10, specifically, from transmission device 110. In such embodiments, wherein the input is received from adjustable leveling assembly 10 or transmission device 110, transmission device 110 may be manually activated (e.g., turned on by the user), at which point it sends a signal to removable mechanical modification management program 340. In some embodiments, a sensor arranged on adjustable leveling assembly 10 detects the removable mechanical modification (i.e., the connection of adjustable leveling assembly 10 to the feeder tray) sends a signal related to such removable mechanical modification via transmission device 110 to removable mechanical modification management program 340.

In some embodiments, the input is received from input data 330. As previously described, input data 330 may include inputs from a cellular telephone or smart phone, a tablet, a remote computing device, or other user personal device. In some embodiments, input data 330 represents a scheduling program that sends the input to removable mechanical modification management program 340. For example, it may be desirable to install adjustable leveling assembly 10 in feeder tray 354B for a predetermined period of time (e.g., 30 days). In such case, the scheduling program sends an input to removable mechanical modification management program 340 wherein the input indicates that feeder tray 354B has been modified with adjustable leveling assembly 10 and that such modification will remain for, at least, the predetermined period of time (e.g., 30 days).

In step 404, removable mechanical modification management program 340 determines the location of the removable mechanical modification. For example, in step 404, removable mechanical modification management program 340 determines the location of adjustable leveling assembly 10. The location may relate to the printing device that adjustable leveling assembly 10 is installed in. For example, if there are ten printing devices on one floor of a building, removable mechanical modification management program 340 will determine the printer, of the ten printing devices, that adjustable leveling assembly 10 is installed in. If a building has five floors with one printing device on each floor, removable mechanical modification management program 340 will determine which floor's printing device has been modified with adjustable leveling assembly 10.

It should be appreciated that the location of the removable mechanical modification can be determined in response to receiving a request for the location or in response to a notification that the removable mechanical modification has been made. For example, in response to receiving an indication that a removable mechanical modification has been made, removable mechanical modification management program 340 determines where that removable mechanical modification has been made (e.g., printing device 350B, third floor, building C, etc.) and stores such information.

In step 406, removable mechanical modification management program 340 determines if the input is related to a request for the location. For example, in step 406, removable mechanical modification management program 340 determines: 1) if the input is related to a request for the location of adjustable leveling assembly 10; or 2) if the input is related to a notification that a removable mechanical modification has been made. It should be appreciated that, in some embodiments, the order of steps 404 and 406 can be reversed such that step 406 is carried out prior to step 404.

If, in step 406, removable mechanical modification management program 340 determines that the input is related to a notification that a removable mechanical modification has been made (e.g., adjustable leveling assembly 10 has been installed in feeder tray 354B), then in step 408 removable mechanical modification management program 340 stores such data in a database (e.g., database 320 or computing device 500).

If, in step 406, removable mechanical modification management program 340 determines that the input is related to a request for the location, then in step 410 removable mechanical modification management program 340 sends the location. For example, if the input requests the location of adjustable leveling assembly 10, the removable mechanical modification management program 340 sends, to the requesting user, the location of adjustable leveling assembly 10. This step may occur, for example, via displaying the location on a user interface or screen (e.g., user interfaces 354A-N, cellular device, personal computer, etc.). This step may also occur by sending a message or electronic communication with such location information (e.g., short message service (SMS), telephone call, multimedia messaging service (MMS), or via any other known message transmission service). The location may include the name of the printing device (e.g., printing device 350A, 350B, or 350N). In some embodiments, sending the location comprises sending the last known location of the removable mechanical modification, namely, adjustable leveling assembly 10. This may be important because a user might remove adjustable leveling assembly 10 from the printing device in which it was last installed and put it next to or near the printing device. Thus, knowing the last known location of adjustable leveling assembly 10 is beneficial in this regard.

In some embodiments, removable mechanical modification management program 340 sends an alert indicating that a removable mechanical modification has been made. For example, if a user would like to print using printing device 350A, removable mechanical modification management program 340 sends an alert to that user (e.g., via SMS, MIMS, etc.) indicating that adjustable leveling assembly 10 is arranged in feeder tray 354A of printing device 350A. The alert may be sent to the user's personal device (e.g., cell phone, laptop, personal computer, tablet, etc.) or to user interface 352A of printing device 350A.

In some embodiments, removable mechanical modification management program 340 sends a notification to monitor an output stacker of the printing device. For example, if adjustable leveling assembly 10 is installed in feeder tray 354B and a user wishes to print using printing device 350B, mechanical modification management program 340 sends a notification to that user to monitor the output stacker of printing device 350B. This is important because if the user is printing specialty sheets 1, which are aligned in feeder tray 354B due to the modification with adjustable leveling assembly 10, such sheets will stack unlevel in the output stacker, which may cause issues. As such, the user must remove specialty sheets 1 from the output stacker prior to an unlevel stack forming and causing issues.

In some embodiments, removable mechanical modification management program 340 detects the number of specialty sheets to be printed, and based thereon, determines whether to send such a notification to monitor the output stack. For example, if only ten specialty sheets 1 are to be printed, such number of sheets will likely not cause stacking issues in the output stacker, and as such, removable mechanical modification management program 340 will not send a notification to monitor. If one hundred specialty sheets are to be printed, such number of sheets will cause stacking issues in the output stacker, and as such, removable mechanical modification management program 340 will send the notification to monitor. In some embodiments, the alert of the removable mechanical modification and the notification to monitor are sent in the same message.

Figure 9:
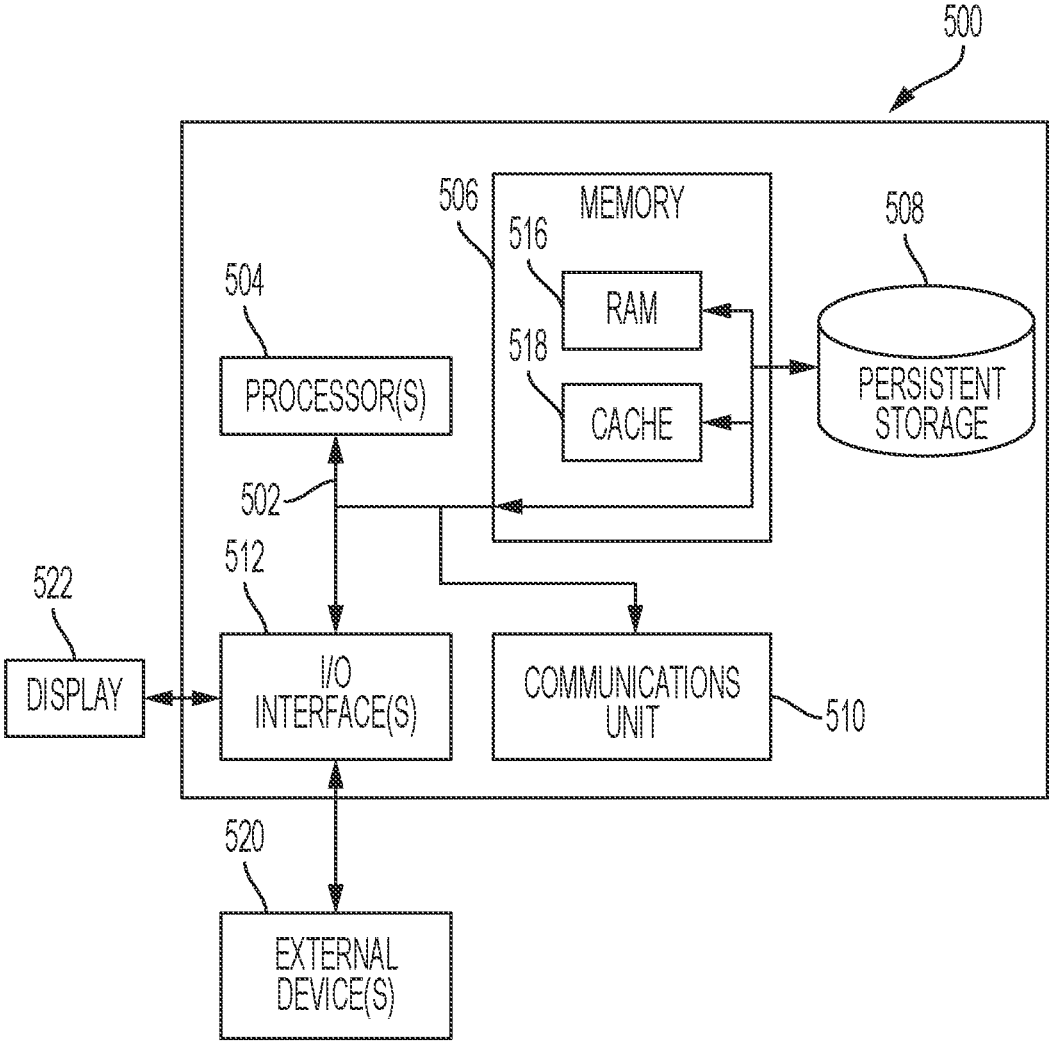

FIG. 9 is a block diagram of internal and external components of computing system 500, which is representative of the computing device of FIG. 7, in accordance with some embodiments of the present disclosure. It should be appreciated that FIG. 9 provides only an illustration of one implementation and does not imply any limitations with regard to the environments in which different embodiments may be implemented. In general, the components illustrated in FIG. 9 are representative of any electronic device capable of executing machine-readable program instructions. Examples of computer systems, environments, and/or configurations that may be represented by the components illustrated in FIG. 9 include, but are not limited to, personal computer systems, server computer systems, thin clients, thick clients, laptop computer systems, tablet computer systems, cellular telephones (i.e., smart phones), multiprocessor systems, microprocessor-based systems, network PCs, minicomputer systems, mainframe computer systems, and distributed cloud computing environments that include any of the above systems or devices.

Computing device 500 includes communications fabric 502, which provides for communications between one or more processing units 504, memory 506, persistent storage 508, communications unit 510, and one or more input/output (I/O) interfaces 512. Communications fabric 502 can be implemented with any architecture designed for passing data and/or control information between processors (such as microprocessors, communications and network processors, etc.), system memory, peripheral devices, and any other hardware components within a system. For example, communications fabric 502 can be implemented with one or more buses.

Memory 506 and persistent storage 508 are computer readable storage media. In this embodiment, memory 506 includes random access memory (RAM) 516 and cache memory 518. In general, memory 506 can include any suitable volatile or non-volatile computer readable storage media. Software is stored in persistent storage 508 for execution and/or access by one or more of the respective processors 504 via one or more memories of memory 506.

Persistent storage 508 may include, for example, a plurality of magnetic hard disk drives. Alternatively, or in addition to magnetic hard disk drives, persistent storage 508 can include one or more solid state hard drives, semiconductor storage devices, read-only memories (ROM), erasable programmable read-only memories (EPROM), flash memories, or any other computer readable storage media that is capable of storing program instructions or digital information.

The media used by persistent storage 508 can also be removable. For example, a removable hard drive can be used for persistent storage 508. Other examples include optical and magnetic disks, thumb drives, and smart cards that are inserted into a drive for transfer onto another computer readable storage medium that is also part of persistent storage 508.

Communications unit 510 provides for communications with other computer systems or devices via a network. In this exemplary embodiment, communications unit 510 includes network adapters or interfaces such as a TCP/IP adapter cards, wireless Wi-Fi interface cards, or 3G or 4G wireless interface cards or other wired or wireless communications links. The network can comprise, for example, copper wires, optical fibers, wireless transmission, routers, firewalls, switches, gateway computers and/or edge servers. Software and data used to practice embodiments of the present disclosure can be downloaded to computing device 500 through communications unit 510 (i.e., via the Internet, a local area network, or other wide area network). From communications unit 510, the software and data can be loaded onto persistent storage 508.

One or more I/O interfaces 512 allow for input and output of data with other devices that may be connected to computing device 500. For example, I/O interface 512 can provide a connection to one or more external devices 520 such as a keyboard, computer mouse, touch screen, virtual keyboard, touch pad, pointing device, or other human interface devices. External devices 520 can also include portable computer readable storage media such as, for example, thumb drives, portable optical or magnetic disks, and memory cards. I/O interface 512 also connects to display 522.

Display 522 provides a mechanism to display data to a user and can be, for example, a computer monitor. Display 522 can also be an incorporated display and may function as a touch screen, such as a built-in display of a tablet computer.

The present disclosure may be a system, a method, and/or a computer program product. The computer program product may include a computer readable storage medium (or media) having computer readable program instructions thereon for causing a processor to carry out aspects of the present disclosure.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present disclosure may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present disclosure.

Aspects of the present disclosure are described herein with reference to flowchart illustrations and/or block diagrams of methods, apparatus (systems), and computer program products according to embodiments of the disclosure. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general-purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the figures illustrate the architecture, functionality, and operation of possible implementations of systems, methods, and computer program products according to various embodiments of the present disclosure. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

It will be appreciated that various aspects of the disclosure above and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

LIST OF REFERENCE NUMERALS

1 Specialty sheet
2 Substrate
3A Card or label or sticker
3B Card or label or sticker
4 Stack
5 Feeder tray
6 Surface
7A Static wall
7B Static wall
8A Movable guide
8B Movable guide
9 Paper trail edge
10 Adjustable leveling assembly
20 Body
22 Top surface
24 Bottom surface
26 Side wall
28 Side wall
30 Aperture
40A Track
40B Track
42A Channel
42B Channel
44A Spaces
44B Spaces
50A Track
50B Track
52A Channel
52B Channel
54A Spaces
54B Spaces
60 Plate(s)
62 Flange(s)
64 Nuts and/or bolts
70 Wedging element
72 Cross-member
74 Cross-member
76A Flange
76B Flange
77A Through-bore
77B Through-bore
78A Flange
78B Flange
79A Through-bore
79B Through-bore
80 Surface
81 Cutout
82 Surface
84 Cutout
90 Surface
92 Roller or axel
94 Roller or axel
94 Retaining element or retaining ring
100 Locking mechanism
110 Wireless transmission device or transponder or transmitter or transmission device
120 Printing device
122 Feeder module
130 Print engine tower
132 Image transfer device
134 Transfer belt
136 Ink dispensers
140 Fuser module
142 Fuser
150 Output module
152 Stacker
160 Finishing or post-process module
170 Wedging element
270 Wedging element
300 Printing system removable mechanical modification environment
310 Network
320 Database
330 Input data
340 Removable mechanical modification management program
350A Printing device
350B Printing device
350N Printing device
352A User interface (UI)
352B User interface (UI)
352N User interface (UI)

354A Feeder tray
354B Feeder tray
354N Feeder tray
356A Sensor
356B Sensor
356C Sensor
358A Sensor
358B Sensor
358C Sensor
400 Flow chart
402 Step
404 Step
406 Step
408 Step
410 Step
500 Computing device
502 Communications fabric
504 Processing units
506 Memory
508 Persistent storage
510 Communications unit
512 Input/output (I/O) interfaces
516 Random access memory (RAM)
518 Cache memory
520 External device(s)
522 Display
D1 Direction
D2 Direction
D3 Direction
D4 Direction
L1 Length
L2 Length
LE Leading edge
R Radius
TE Trailing edge
α Angle
β Angle

What is claimed is:

1. A method of managing removable mechanical modifications to one or more printing devices, comprising:
receiving, by one or more computer processors, an input related to a removable mechanical modification of a printing device of the one or more printing devices;
determining, by the one or more computer processors, that the input is related to a request for a location of the removable mechanical modification;
determining, by the one or more computer processors, the location; and,
sending, by the one or more computer processors, the location.

2. The method as recited in claim 1, wherein the input is received from the printing device.

3. The method as recited in claim 2, wherein:
the removable mechanical modification is detected by a sensor of the printing device; and,
the input is received from a transmitter of the printing device.

4. The method as recited in claim 1, wherein the removable mechanical modification comprises modifying a feeder tray of the printing device to include an adjustable leveling assembly.

5. The method as recited in claim 4, wherein the input is received from a transmission device of the adjustable leveling assembly.

6. The method as recited in claim 1, wherein the step of sending the location comprises:
sending, by the one or more computer processors, a name of the printing device.

7. The method as recited in claim 1, wherein the step of sending the location comprises:
displaying, by the one or more computer processors, the location on a user interface.

8. The method as recited in claim 1, further comprising:
determining, by the one or more computer processors, that the input is not related to a request for the location; and,
storing, by the one or more computer processors, the location.

9. The method as recited in claim 8, further comprising:
sending, by the one or more computer processors, an alert indicating that a removable mechanical modification to the feeder tray exists.

10. The method as recited in claim 8, further comprising:
sending, by one or more computer processors, a notification to monitor an output stacker of the printing device.

11. A computer system for managing removable mechanical modifications to a printing system, comprising:
at least one printing device, including:
a feeder tray;
an output stacker; and,
a first user interface;
an adjustable leveling assembly including a transmission device;
one or more computer processors;
one or more computer readable storage media;
program instructions stored on the computer readable storage media for execution by at least one of the one or more computer processors, the program instructions comprising:
program instructions to receive an input related to a removable mechanical modification; and,
program instructions to determine a location of the removable mechanical modification.

12. The computer system as recited in claim 11, wherein the removable mechanical modification comprises the arrangement of the adjustable leveling assembly on the feeder tray.

13. The computer system as recited in claim 12, wherein the input is received from the first user interface.

14. The computer system as recited in claim 12, wherein the input is received from the transmission device of the adjustable leveling assembly.

15. The computer system as recited in claim 12, further comprising:
program instructions to determine that the input is related to a request for the location; and,
program instructions to send the location.

16. The computer system as recited in claim 12, further comprising:
program instructions to determine that the input is not related to a request for the location; and,
program instructions to store the location.

17. The computer system as recited in claim 16, further comprising:
program instructions to send an alert indicating that the adjustable leveling assembly is arranged on the feeder tray.

18. The computer system as recited in claim 16, further comprising:
program instructions to send an alert indicating that the adjustable leveling assembly is arranged on the feeder tray; and,
program instructions to send a notification to monitor the output stacker.

19. A method of managing removable mechanical modifications to a plurality of printing devices, comprising;

receiving an indication that a feeder tray of a printing device of the plurality of printing devices has been modified to include an adjustable leveling assembly;

determining a location of the printing device;

storing the location; and, sending an alert indicating that the adjustable leveling assembly is arranged on the feeder tray.

* * * * *